US006574598B1

(12) United States Patent
Nakatsuyama et al.

(10) Patent No.: US 6,574,598 B1
(45) Date of Patent: Jun. 3, 2003

(54) TRANSMITTER AND RECEIVER, APPARATUS AND METHOD, ALL FOR DELIVERY OF INFORMATION

(75) Inventors: Takashi Nakatsuyama, Chiba (JP); Tsutomu Imai, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/381,255

(22) PCT Filed: Jan. 13, 1999

(86) PCT No.: PCT/JP99/00092

§ 371 (c)(1),
(2), (4) Date: Nov. 18, 1999

(87) PCT Pub. No.: WO99/36905

PCT Pub. Date: Jul. 22, 1999

(30) Foreign Application Priority Data

Jan. 19, 1998 (JP) ..... 10-007777

(51) Int. Cl.[7] ..... G10L 13/08; G10L 19/14; G10L 21/06

(52) U.S. Cl. ..... 704/260; 704/500; 704/201; 704/258

(58) Field of Search ..... 704/258, 260, 704/273, 500, 201

(56) References Cited

U.S. PATENT DOCUMENTS 4,908,867 A * 3/1990 Silverman ..... 704/260
5,668,926 A * 9/1997 Karaali et al. ..... 704/260
5,673,362 A * 9/1997 Matsumoto ..... 704/260
5,920,835 A * 7/1999 Huzenlaub et al. ..... 704/235
5,940,796 A * 8/1999 Matsumoto ..... 704/260
6,061,718 A * 5/2000 Nelson ..... 704/260
6,374,223 B1 * 4/2002 Donaldson et al. ..... 704/260
6,466,909 B1 * 10/2002 Didcock ..... 704/260

FOREIGN PATENT DOCUMENTS

EP 0319178 A2 11/1988
EP 0542628 A2 11/1992
EP 09135264 8/1995

OTHER PUBLICATIONS

Camper E–mail Authorization ("Indian Summer Camp", Aug. 1997).*

* cited by examiner

*Primary Examiner*—Doris H. To
*Assistant Examiner*—Daniel V Nolan
(74) *Attorney, Agent, or Firm*—Jay H. Maioli

(57) ABSTRACT

A transmitter and receiver adapted to deliver transformed information obtained by transforming the text information of an electronic mail into intermediate language information as voicing information. The transmitting apparatus generates intermediate language information on the basis of the text data received by the transmitting apparatus and also transformed information on the basis of the intermediate language information and transmits the information to the receiving apparatus. Upon receiving the transformed information, the receiving apparatus retrieves the intermediate language information from the received transformed data, and carries out an operation of voice synthesis on the basis of the retrieved intermediate language information and outputs the synthesized voice.

37 Claims, 13 Drawing Sheets

| TEXT | 「ホンジツワ　セイテンナリ」 |
|---|---|
| INTERMEDIATE LANGUAGE STRING mT | EXAMPLE 1<br>「honnjiituuwa-seiitennari」<br><br>EXAMPLE 2<br>「tudei-iz-fain」<br>( today is fine )<br><br>＊INCLUDES CASES WHERE DATA FOR INTONATIONS, ACCENTS, SOUND VOLUMES ARE ADDED. |

FIG.12

TRANSMITTER AND RECEIVER, APPARATUS AND METHOD, ALL FOR DELIVERY OF INFORMATION

TECHNICAL FIELD

This invention relates to an information delivery apparatus, an information transmitter, an information receiver and an information delivering method to be used for delivering information as transformed into intermediate language information for voicing the text information of electronic mail.

BACKGROUND ART

Electronic mail is currently popularly used for delivering texts. The users (subscribers) of electronic mail systems typically utilize personal computers to transmit and receive an electronic mail.

The receiving party of an electronic mail normally confirms the reception by displaying the transmitted text data of the electronic mail on the display screen of his or her personal computer located, for example, in the house. However, there may be occasions where it is desirable that the user who received an electronic mail can confirm the reception of the mail by means of a portable terminal unit.

Furthermore, it may be very convenient if the text of the received electronic mail is voiced by such a portable terminal unit particularly when the user is moving in an automobile or working outdoors.

However, an operation of artificially reading the text of a mail requires a process of language analysis including paragraph analysis and that of voice synthesis. Particularly, a process of language analysis requires a vast amount of dictionary data and grammar data and hence it is believed that a small portable terminal unit can hardly be equipped with hardware and software necessary for carrying out such a process.

For example, a vast amount of dictionary data and grammar data will have to be made available in a process of analyzing text data for the purpose of voice synthesis particularly if no limitations are provided on the text to be analyzed. Additionally, a very complex process of analyzing intonations and accents will be needed to improve the sound quality of voice output and such a process will pose a heavy load on the part of the terminal unit, which by turn will obstruct the efforts for reducing the dimensions and the cost of such terminal units if they are to be made popular.

On the other hand, a service system for delivering information by way of a telecommunication network where the server of the system transforms the text of an electronic mail into a sound signal (digital or analog audio signal) and transmitting the sound signal to the terminal unit of the addressee by way of a telecommunication line may be conceivable. Then, the terminal unit will only have to carry out a predetermined audio processing operation on the received sound signal before it voices the text of the electronic mail so that the load on the part of the terminal unit will be very light.

However, the obtained sound signal transmitted from the server to the user may be required to be compressed in order to reduce the volume of data to be transmitted through the line when the telecommunication network intends to improve the efficiency of data transmission. Then, as a result of the signal compression, the quality of the transmitted audio signal will be degraded considerably to make it impossible to provide a high quality voice service to the user at the terminal unit. If, on the other hand, the signal compression is avoided to maintain the original high voice quality, a long transmission time will be consumed also to a great disadvantage on the part of the user.

DISCLOSURE OF THE INVENTION

In view of the above identified problems, it is therefore the object of the present invention to provide a novel transformed information delivery system that does not pose a heavy load on the receiving terminal unit and, at the same time, can improve the quality of voice information, while it can reduce the transmission time and improve the applicability, usability and efficiency of the system.

According to the invention, the above object is achieved by providing a transformed information delivery system comprising a transmitter arranged at the server of the system and having a first reception means for receiving text information, an intermediate language information generating means for transforming the text information received by the first reception means into intermediate language information for voicing the text information, a transformed information generating means for generating transformed information at least by using intermediate language information and a transmission means for transmitting the transformed information generated by the transformed information generating means and a receiver arranged at a user of the system as user terminal and having a second reception means for receiving the transformed information transmitted from the transmission means, a voice synthesizing means for retrieving at least intermediate language information from the transformed information received by the second reception means, carrying out an operation of voice synthesis by using the intermediate language information and generating voice synthesis information and an output means for outputting the voice synthesis information generated by the voice synthesizing means.

Thus, upon receiving a set of text data, or a text data string, for an electronic mail addressed to a user, or a subscriber, from another user, or another subscriber, to whom service has to be provided by the system, the server transforms the text data into intermediate language information in a form adapted to be used directly for voice synthesis. Then, the transformed information in a predetermined data format of the intermediate language information is transmitted to the terminal unit of the user who is the addressee of the electronic mail. Thus, the amount of data to be transmitted can be remarkably reduced if compared with the amount of data to be transmitted when the sound signal of the text of the electronic mail is transmitted without transformation and, at the same time, the voice output from the terminal unit can be made to be of a high quality owing to the analysis of the text data carried out by the server in a sophisticated way. It may be needless to say that the terminal unit is not required to be equipped with hardware and software for analyzing the text data.

Additionally, not only the intermediate language information to be transmitted as transformed information but also the data on the original text can be transmitted so that the original text is not only voiced but also displayed at the destination terminal unit.

Other objects and advantages of the present invention will become apparent from the following description made by referring to the accompanying drawings that illustrate preferred embodiments of the invention.

BRIEF DESCRIPTION OF THE DRAWINGS

FIG. 12 schematically illustrates exemplary data of a transformed mail that can be used for the purpose of the invention.

BEST MODES FOR CARRYING OUT THE INVENTION

Now, an information delivery apparatus, an information transmitter, an information receiver and an information delivering method according to the invention will be described by referring to the accompanying drawings that illustrate preferred embodiments of the invention.

Firstly, a transformed information delivery system according to the invention will be described. It is a system of delivering an electronic mail to the addressee of the mail who is a user of the system with added intermediate language information for voicing the text of the electronic mail. It is particularly suited for artificially reading the electronic mail for the user by means of the user's terminal.

Figure 1:
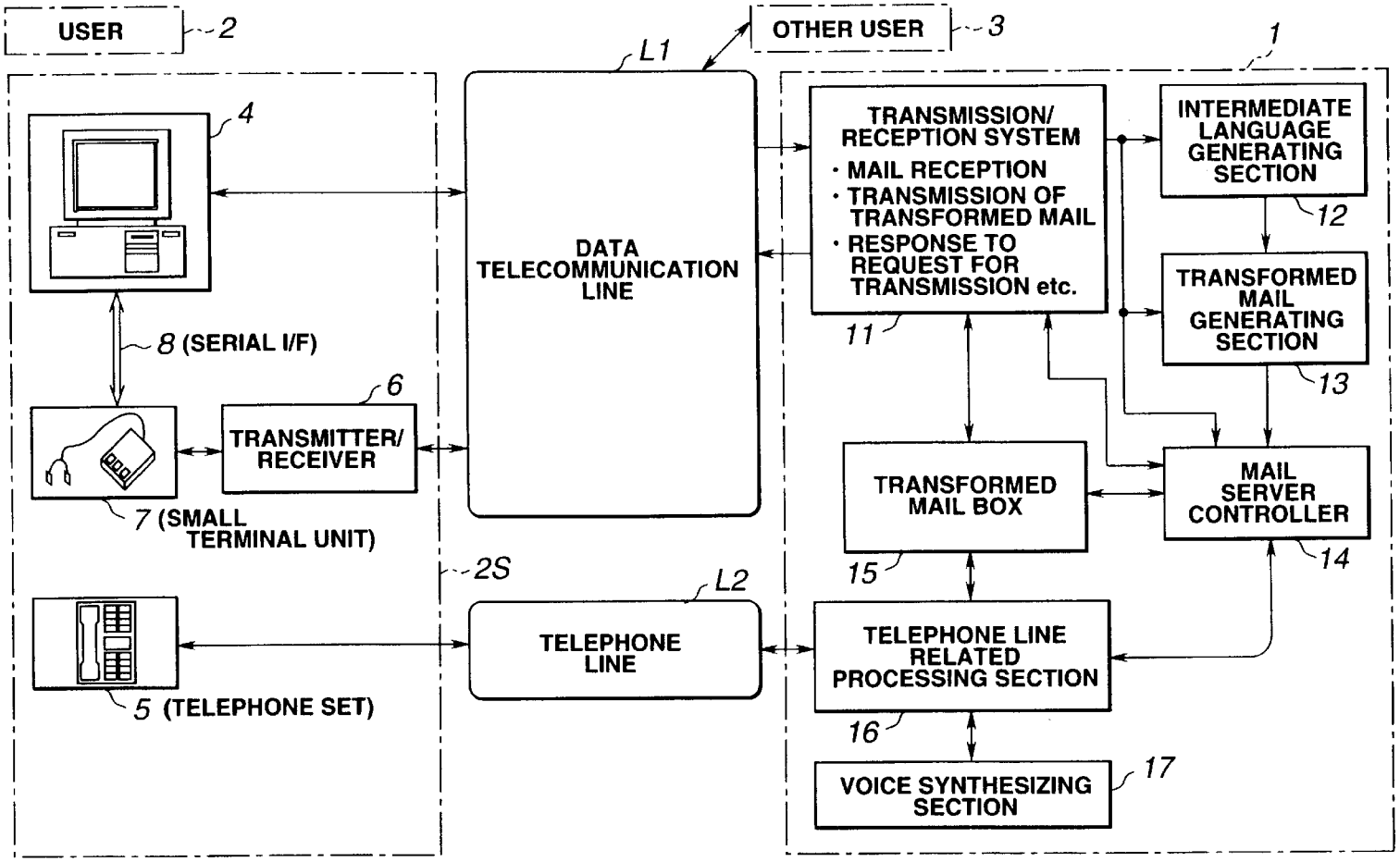
FIG. 1 is a schematic block diagram of an embodiment of intermediate delivery apparatus according to the invention.

Referring to FIG. 1, the transformed information delivery system comprises a server 1 operating for the service provider of the system and a plurality of user terminals connected to the server 1 by way of a data telecommunication line L1 or a telephone line 2 (audio line).

User's system 2S that is used by each user 2 is provided with hardware and software necessary for utilizing the transformed information delivery system and adapted to carry out various operations including registration necessary for receiving services from the system. As shown in FIG. 1, the system 2S may comprise a personal computer 4, a telephone set 5, a small terminal unit 7 and a transmitter/receiver 6. However, any user can receive services from the server 1 if the system 2S comprises at least a personal computer 4, a telephone set 5 or a small terminal unit 7.

Other users of the system may be able to receive services from the server 1 same as those described above for the user 2 or any of the users may not want to receive such services. For the above transformed information delivery system, the user who exchanges electronic mails with the user 2 should be provided with a personal computer and/or other equipment necessary for the system.

Of the user's system 2S, the personal computer 4 is typically a general purpose personal computer of any type that is currently available and adapted to transmit and receive electronic mails when connected to a data telecommunication line L1. Additionally, in the above described system, the personal computer 4 is provided with a functional feature of voice synthesis and voice output and can output a voiced text data for the electronic mail it receives by way of the server 1.

The telephone set 5 is adapted to an ordinary push-phone line. In the above described system, it can receive a voiced electronic mail addressed to the user by way of the server 1 to which it is connected by line.

The small terminal unit 7 is typically a compact and lightweight portable terminal unit dedicated to the confirmation of reception of electronic mails.

The small terminal unit 7 can be used for transmission and reception of electronic mails when connected to the personal computer 4 and a serial interface 8 or to a dedicated transmitter/receiver 6.

The small terminal unit 7 is also provided with a functional feature of voice synthesis and voice output and can output a voiced text data for the electronic mail it receives by way of the server 1. The server 1 comprises a transmission/reception system 11, an intermediate language generating section 12, a transformed mail generating section 13, a mail server controller 14, a transformed mail box 15, a telephone line related processing section 16 and a voice synthesizing section 17.

The server 1 generates a transform mail data on the basis of the text data of the electronic mail it receives for a user 2 and intermediate language information obtained by transforming the text data and transmits the transformed mail data to the user's system 2S. Thus, the transmission/reception system 11 of the server 1 comprises a section for exchanging data with the user by way of the data telecommunication line L1. Thus, the transmission/reception system 11 receives electronic mails for which the server provides services. An electronic mail for which the server 1 provides services as used herein may be one addressed to a user 2 from an other user 3, one received by the user 2 and transmitted to the server 1 in order to receive services from the server 1 or one transmitted directly from the other user 3 and addressed to the user 2.

Upon receiving an electronic mail for which it provides services, the transmission/reception system 11 transfers the text data of the received electronic mail to the intermediate language generating section 12, the transformed mail generating section 13 and the mail server controller 14 for respective processing operations.

The intermediate language generating section 12 transforms the text data it receives into intermediate language information mT as voicing information on the basis of each transformed text string tTX that is a character string and send the information to the transform mail generating section 13, although the operation of the intermediate language generating section 12 and that of the transformed mail generating section 13 will be discussed in greater detail hereinafter.

For the purpose of the invention, intermediate language information mT may be generated as voicing information by translating or transforming the original text data into some other language without modifying the contents. For example, the character strings of the text data of an electronic mail written in Japanese may be transformed into text data of an electronic mail obtained by translating the original mail into English, French or German without modifying the contents, from which intermediate language information mT may be generated as voicing information. Or, the text data of an electronic mail written in standard Japanese may be transformed into text data of an electronic mail obtained by rewriting the original mail in the Tohoku dialect, the Osaka dialect or the Kyushu dialect of Japanese without modifying the contents, from which intermediate language information mT may be generated as voicing information.

The transformed mail generating section 13 generates data strings as transformed data, using the text data and the intermediate language information mT supplied to it. The transformed data will then be supplied to the mail server controller 14 and stored in the transformed mail box 15 as transformed mail or transmitted from the transmission/reception system 11. The transformed mail box 15 is a memory section having a relatively large memory capacity for storing or holding transformed data. The transformed data that is stored or held in the transformed mail box 15 is then transmitted from the transmission/reception system 11 to the personal computer 4 or the transmitter/receiver 6 of the user's system 2S by way of the data telecommunication line L1. Thus, the user 2 can receive data as transformed data obtained by adding the intermediate language information mT to the text data of the original electronic mail.

The mail server controller 14 operates as principal controller for controlling the operations of the server 1. More specifically, the mail server controller 14 controls the registration of each user or subscriber, the identity of each user requesting services and the billing for the services it provides. It also controls the operation of storing transformed data in and retrieving or reading transformed data from the transformed mail box 15, that of confirming the contents of the electronic mail it receives from the transmission/reception system 11 and that of transmitting a given transformed mail to the addressee.

As services can be provided by way of a telephone line L2 for the purpose of the invention, the telephone line related processing section 16 connects the line to receive the ID code data from a calling user. When a transformed mail is to be transmitted by way of a telephone line L2, the intermediate language information mT contained in the transformed data for the transformed mail to be transmitted is processed by the voice synthesizing section 17 under the control of the mail server controller 14 to generate a sound signal. The generated sound signal representing the voiced original electronic mail is then transmitted to the telephone set 5 of the user 2, or the addressee, connected to the telephone line related processing section 16 by way of the telephone line L2.

Now, the small terminal unit of the user's system 2S will be described in detail.

The users, or the subscribers, who receives transformed information delivery services from the server 1 can utilize a small terminal unit 7 that is a compact and lightweight portable terminal unit.

When using a small terminal unit 7, the user connects it to a personal computer 4 or a transmitter/receiver 6 of the system. A transmitter/receiver 6 may be arranged at a railway station or in a convenience store and can be accessed by any user of the system and connected to the small terminal unit 7 of the user. Of course, the small terminal unit 7 may be connected to the transmitter/receiver 6 owned by the user and located typically in his or her own house. Thus, the small terminal unit 7 can be connected to and communicate with the server 1 by way of a transmitter/receiver 6 or a personal computer 4 that is connected to the data telecommunication line L1.

The data telecommunication line L1 may be an ISDN (integrated services digital network) or a telecommunication line dedicated to information delivery services. The transmission path of the data telecommunication line L1 does not necessarily have to be wired and it may totally or partly be a radio telecommunication line.

The small terminal unit 7 and the transmitter/receiver 6 may be connected to each other as the former incorporates the latter as part thereof or vice versa. Alternatively, they may be connected to each other by way of a cable, an infrared ray, an electric wave or a radio wave.

The user can receive the transformed mail addressed to him or her by connecting his or her small terminal unit 7 to the server 1 by way of the transmitter/receiver 6 and the telecommunication line. The original electronic mail that is put into a transformed mail by the server 1 may be transmitted from the user 2 to the server 1 when the latter wants services to be provided for the mail. If such is the case, the original electronic mail that is received by the user 2 typically by way of the personal computer 4 may be transmitted to the server 1 also by way of the personal computer 4 or by way of the small terminal unit 7.

The user 2 can use the small terminal unit 7 in order to request that the transformed mail data obtained by transforming the electronic mail addressed to him or her is retrieved from the transformed mail box 15 and receive the transformed mail data once retrieved from the mail box 15. The transformed mail data transmitted from the server 1 is received by the transmitter/receiver 6 or the personal computer 4 and the transformed mail data that is addressed to and received by the user 2 is processed by the small terminal unit 7 and output as speech and image.

Now, a possible configuration of the transmitter/receiver 6 and that of the small terminal unit 7 will be described below by referring to FIG. 2.

The transmitter/receiver 6 comprises a modem 62 having a terminal 61 connected to the data telecommunication line L1 so as to be able to communicate with the server 1.

Figure 2:
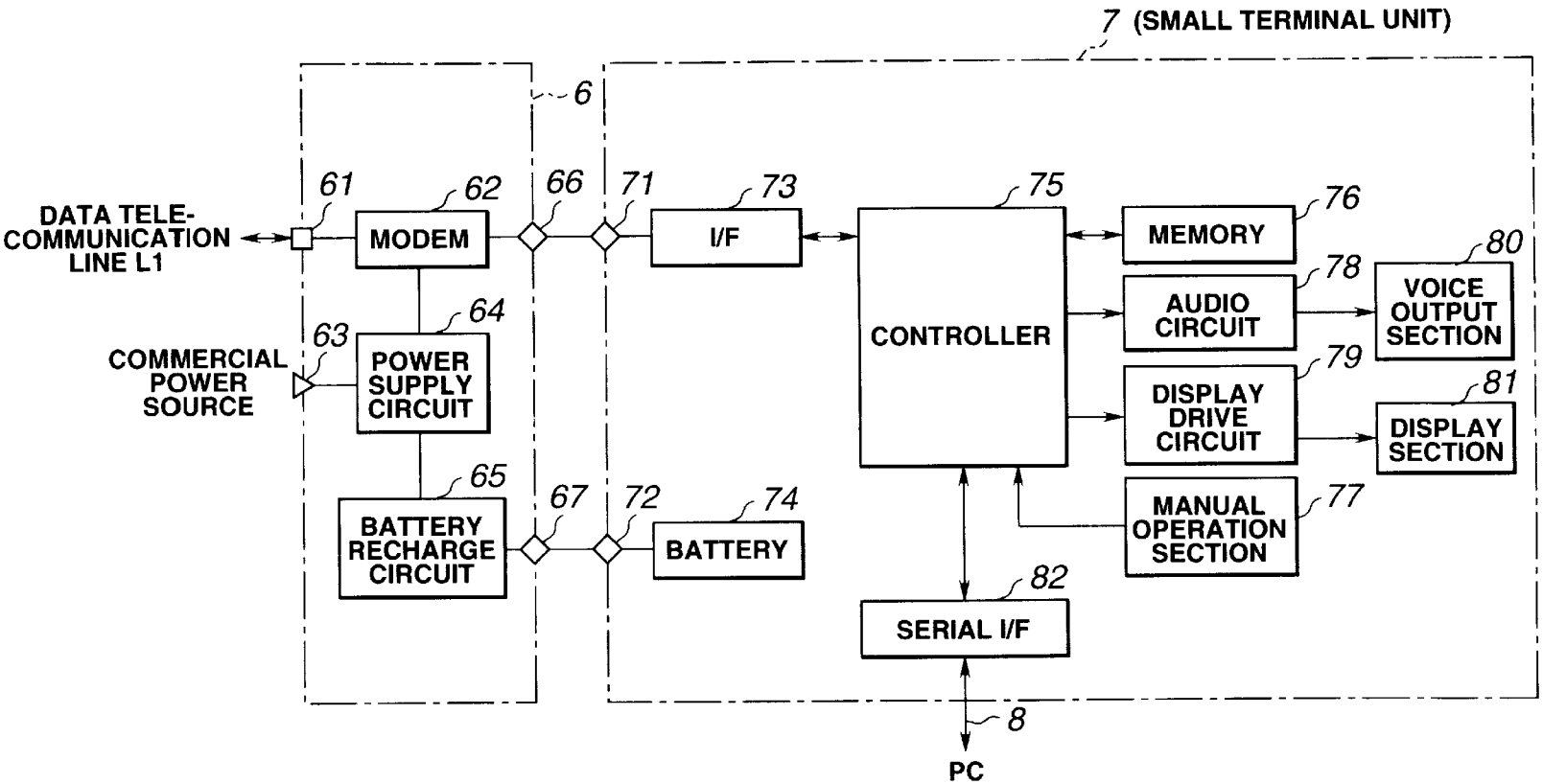
FIG. 2 is a schematic block diagram of a small terminal unit and an embodiment of transmitter/receiver according to the invention.

In the configuration of FIG. 2, the transmitter/receiver 6 is connected to a commercial power source by way of a power supply terminal (plug socket) 63 to obtain an operating supply voltage by rectifying and smoothing the supplied power by means of its power supply circuit 64. It also comprises a battery recharge circuit 65 for recharging the battery 74 contained in the small terminal unit 7. Thus, as the transmitter/receiver 6 is connected to the small terminal unit 7, the terminal 67 of the former is connected to the terminal 72 of the latter so that the battery recharge circuit 65 can supply a recharge current to the battery 74. Therefore, the small terminal unit 7 is driven to operate by the battery 74 that produces the operating supply voltage and is recharged by way of the transmitter/receiver 6 connected to the small terminal unit 7.

Additionally, as the transmitter/receiver 6 is connected to the small terminal unit 7, the terminal 66 of the modem 62 of the transmitter/receiver 6 is connected to terminal 71 of interface section 73 of the small terminal unit 7 so that the transformed mail transmitted from the server 1 is received by controller 75 of the small terminal unit 7 by way of the modem 62 and the interface section 73 of the small terminal unit 7. The information transmitted from the user is conveyed to the server 1 by way of the interface 73 and the modem 62 under the control of the controller 75.

The controller 75 typically comprises a microcomputer, which controls the operation of each of the component sections of the small terminal unit 7, monitors the manual operation of the user through the manual operation section 77 and processes information necessary for audiovisually outputting the transformed mail received by the small terminal unit 7. While the operation of processing information necessary for audiovisually outputting a transformed mail will be described in greater detail by referring to FIG. 13 hereinafter, it includes separation of the text data and the intermediate language information contained in the transformed mail data and voice synthesis realized on the basis of the obtained intermediate language information. The controller 75 processes the necessary information, utilizing a memory 76. The memory 76 typically comprises a ROM or RAM storing parameters necessary for driving an operation program and executing various processing operations along with phonemic information necessary for voice synthesis, a RAM for storing the information contained in the transformed mail and a RAM for providing a work area.

The small terminal unit 7 also comprises an audio circuit 78 and a voice output section 80 for outputting voices. The intermediate language information is isolated from the remaining transformed mail data by the controller 75 and the synthesized voice information generated as sound information as a result of the voice synthesis realized on the basis of the isolated intermediate language information is subjected to various processing operations of the audio circuit 78 including D/A conversion, equalization and amplification before it is supplied to the voice output section 80. The voice output section 80 typically comprises a loudspeaker or a headphone and outputs a voice to the user on the basis of the synthesized voice information. Thus, the user can hear the voiced electronic mail as service provided by the server 1.

The small terminal unit 7 additionally comprises a display drive circuit 79 and a display section 81 as its display/output system. As the text data is isolated from the transformed mail data as a result of the processing operation of the controller 75, it is then supplied to the display drive circuit 79. The display drive circuit 79 by turn drives the display section 81 according to the supplied text data so that the text data may be output and displayed as characters to the user. The display section 81 typically comprises a liquid display panel or a display tube. Thus, as the text data is displayed on the display section 81, the user can read the text of the electronic mail on the display section 81 as he or she hears the voiced letter output from the voice output section 80.

The manual operation section 77 typically comprises a keyboard carrying a number of operation keys to be manually operated by the user. For example, the user may input a request for a service such as retrieving a transformed mail from the transformed mail box 15 or direct to output the received information as voiced information and/or displayed information by operating the keyboard. The controller 75 executes necessary processing operations according to the input through the manual operation section 77.

The small terminal unit 7 further comprises a serial interface section 82 for operating as interface when the unit is connected to the personal computer 4. The controller 75 can transmit information to and/or receive transformed electronic mails from the personal computer 4 by way of the serial interface section 82.

While the personal computer 4 of the user's system 2S will not be described in detail any further, it is sufficient for it to be functionally compatible with the transmitter/receiver 6 and the small terminal unit 7 as shown in FIG. 2.

Figure 3:
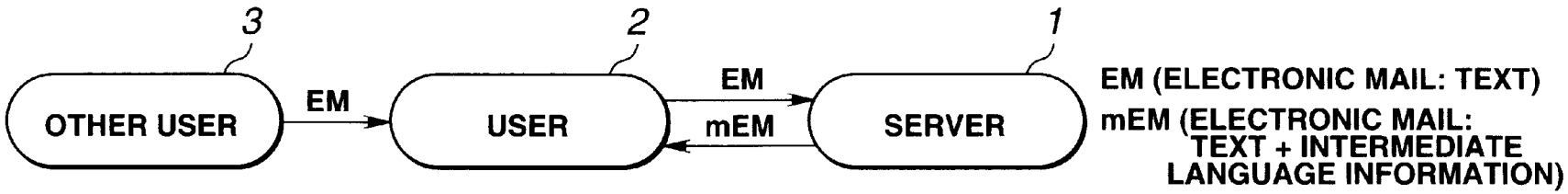
FIGS. 3, 4 and 5 schematically illustrate respective modes of transmitting a transformed mail according to the invention.
Figure 4:
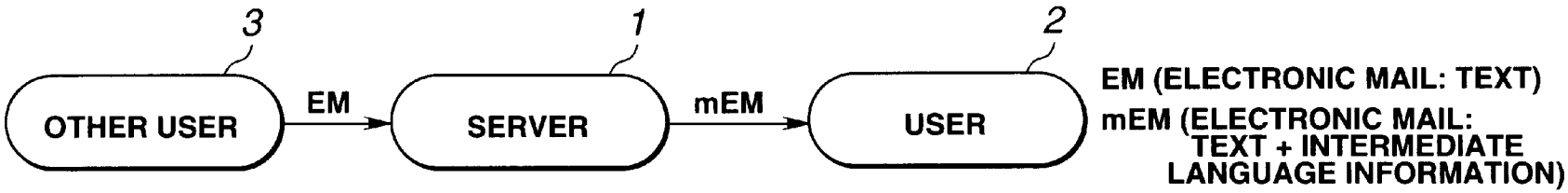
Figure 5:
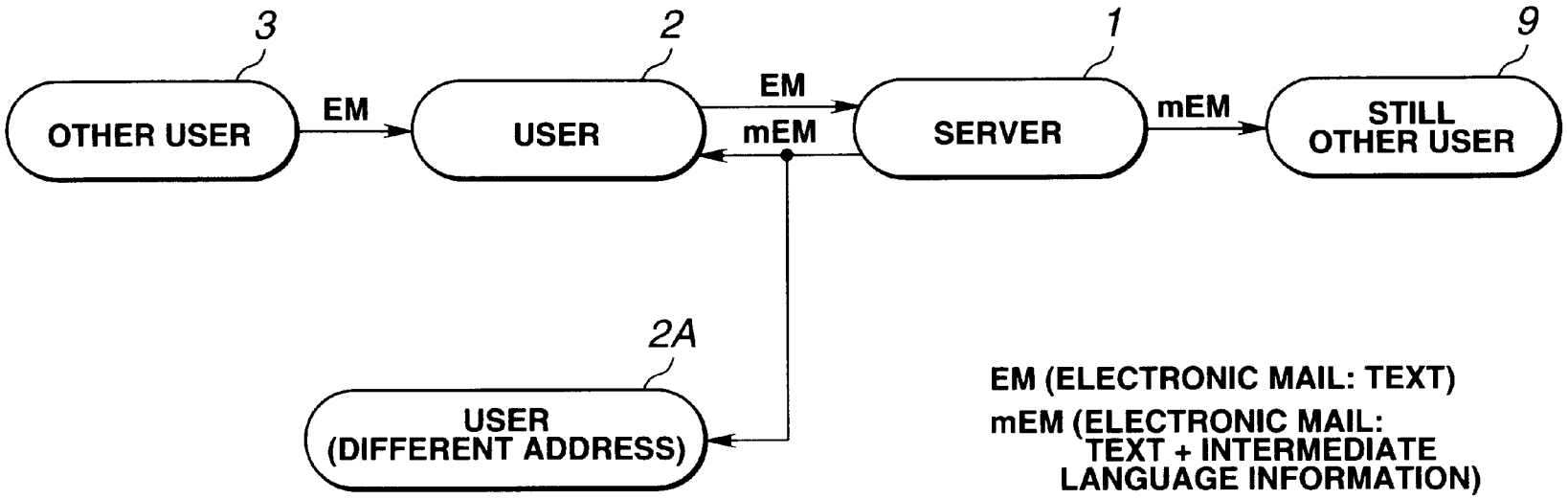

While a transformed information delivery system having a configuration as described above may be realized in various different modes, FIGS. 3, 4 and 5 illustrate so many examples conceivable for the configuration of such a system, although the present invention is by no means limited thereto.

FIG. 3 shows a system configuration where an electronic mail EM can be transmitted to a user 2 registered for services to the server 1 from an other user 3.

The other user 3 may transmit the electronic mail EM in any currently popular mode of electronic mail transmission.

While the user 2 can display the received electronic mail EM on the display screen of the personal computer 4, he or she will forward the received electronic mail EM (text data) to the server 1 if the user 2 wants to receive services from the server 1. Then, the server 1 carries out predetermined processing operations on the text data as will be described hereinafter and adds the obtained intermediate language information to the text data to generate a transformed electronic mail mEM, which is then returned to the user 2.

The server 1 may return the transformed electronic mail mEM to the user 2 immediately after generating the transformed data, or the transformed electronic mail mEM, or, alternatively, the server 1 may temporarily store the transformed data, or the transformed electronic mail mEM, in the transformed mail box 15 and transmits it back to the user when the server 1 receives a request for retrieving the transformed data from the user 2.

Upon receiving the transformed electronic mail mEM, the user 2 can confirm the contents of the original electronic mail EM as it is voiced and/or displayed on the display screen of the personal computer 4 or the small terminal unit 7 of the user's system 2S by utilizing the intermediate language information, or the transformed data, of the transformed electronic mail mEM and the text data.

FIG. 4 shows an alternative system configuration where an electronic mail EM can be transmitted to the user 2 from the other user 3 by way of the server 1.

More specifically, the other user 3 transmits the electronic mail EM after requesting that the electronic mail EM be forwarded to the user 2 by the server 1. Then, upon receiving the electronic mail EM, the server 1 carries out predetermined processing operations on the text data and adds the obtained intermediate language information to the text data to generate a transformed data as described above by referring to FIG. 3, which transformed data is then stored in the transformed mail box 15 as transformed electronic mail mEM.

FIG. 5 shows a still alternative configuration obtained by extending the arrangement of FIG. 3.

In this configuration, the user 2 is supposed to forward the received electronic mail EM to the server 1, requesting services by specifying the address to which the electronic mail EM should be sent. Then, the server 1 may transmit the transformed electronic mail mEM to the original address and also to the address specified by the user 2 if the latter address differs from the former address. If the user 2 wants some other user 3 to hear the voiced electronic mail EM addressed to the user 2, the user 2 can specify the address of that other user 3 so that the server 1 may transmit the transformed electronic mail mEM to that other user 3 and make the latter hear the voiced electronic mail EM.

Thus, the user may utilize such a delivery arrangement as if the user 2 provides a carbon copy (CC) of mail headers showing addresses to which an electronic mail EM is to be delivered.

With any of the above described modes of delivering transformed electronic mails mEM, various services may be provided to the subscribers of the system.

Now, the operation of transmitting a transformed electronic mail by means of the information delivery system and the transmitter/receiver described above by referring to FIGS. 1 and 2 will be described in terms of the system configuration of FIG. 3.

However, it should be noted that the below described operation is substantially common to the system configurations of FIGS. 4 and 5 for transmitting transform electronic mails.

Figure 6:
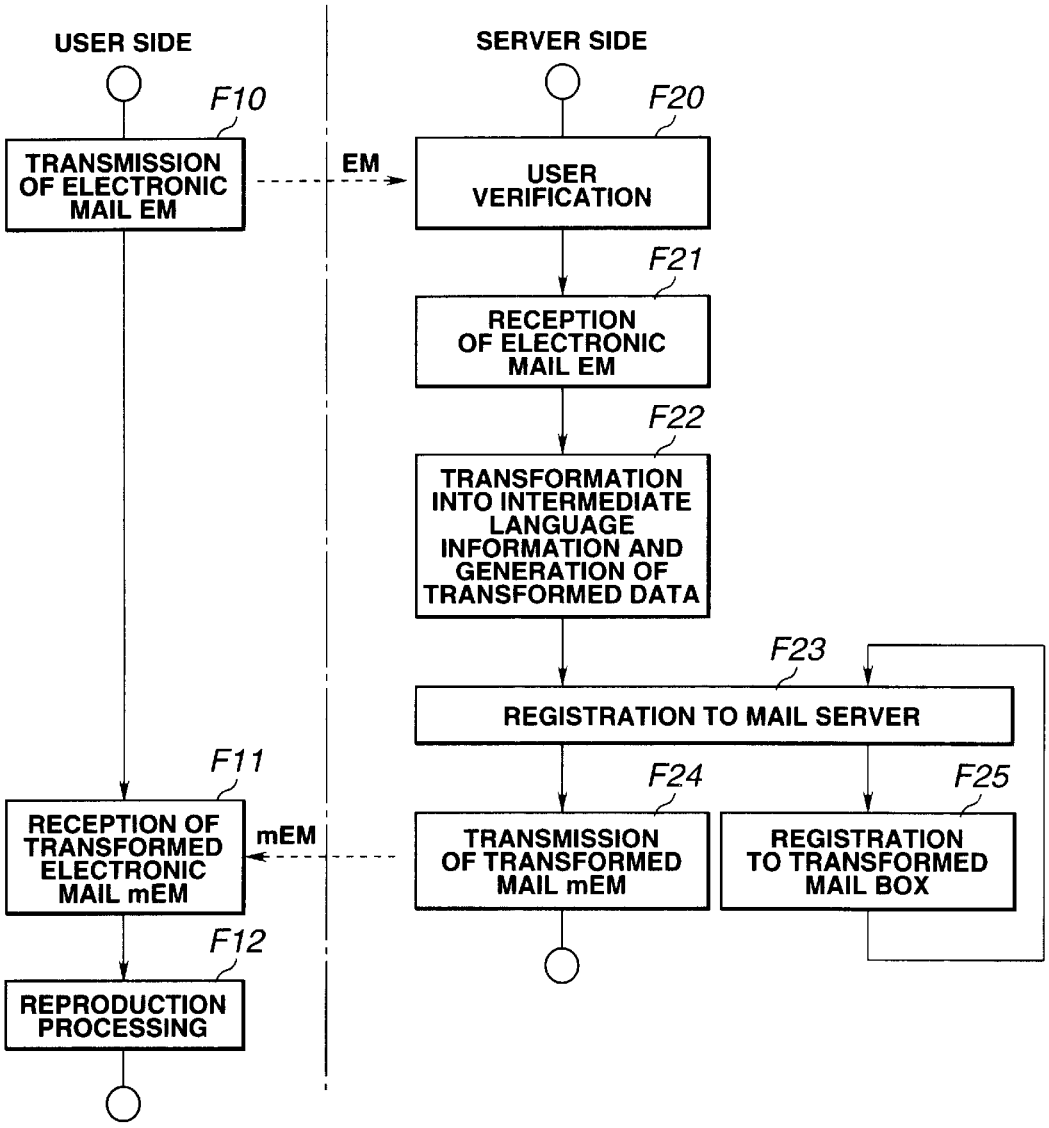
FIG. 6 is a flow chart of a mode of operation of transforming and transmitting a mail according to the invention.

FIG. 6 is a flow chart of a processing operation of the server 1 of the system of FIG. 3, where user 2 transmits an electronic mail EM to the server 1 and the server 1 generates a transformed data string as transform electronic mail mEM from the electronic mail and transmits it to the user 2. While this operation is suitably for an occasion where the user 2 uses his or her personal computer 4, the user 2 may alternatively use a small terminal unit 7 if it is connected to the personal computer 4.

In Step F10, the user 2 transmits the text data of the electronic mail EM addressed to him or her from some other user 3 to the server 1 by way of the personal computer 4 or the small terminal unit 7.

Upon receiving the text data from the user 2, the server 1 verify the user 2 in Step F20. More specifically, the user transmits the text data with the own ID data and the mail server controller 14 of the server 1 checks and verifies the registration of the user 2 on the basis of the ID data received by the transmission/reception system 11 to see if the user 2 is authorized to receive services of the system.

If it is verified in Step F20 that the user is a user authorized to receive services of the system, the transmitted electronic mail EM containing the text data is then taken in from the transmission/reception system 11 and applied to the intermediate language generating section 12 and the transformed mail generating section 13 for respective processing operations in Step F21.

Then, in Step F22, the text data is transformed into intermediate language processing information mT and a transformed electronic mail mEM is generated as transformed data by using the text data and the intermediate language information mT.

Now, the operation of transforming the text data into intermediate language information mT and that of generating a transformed electronic mail mEM as transformed data by using the generated intermediate language information mT and the text data will be discussed in greater detail by referring to FIG. 9.

Figure 9:
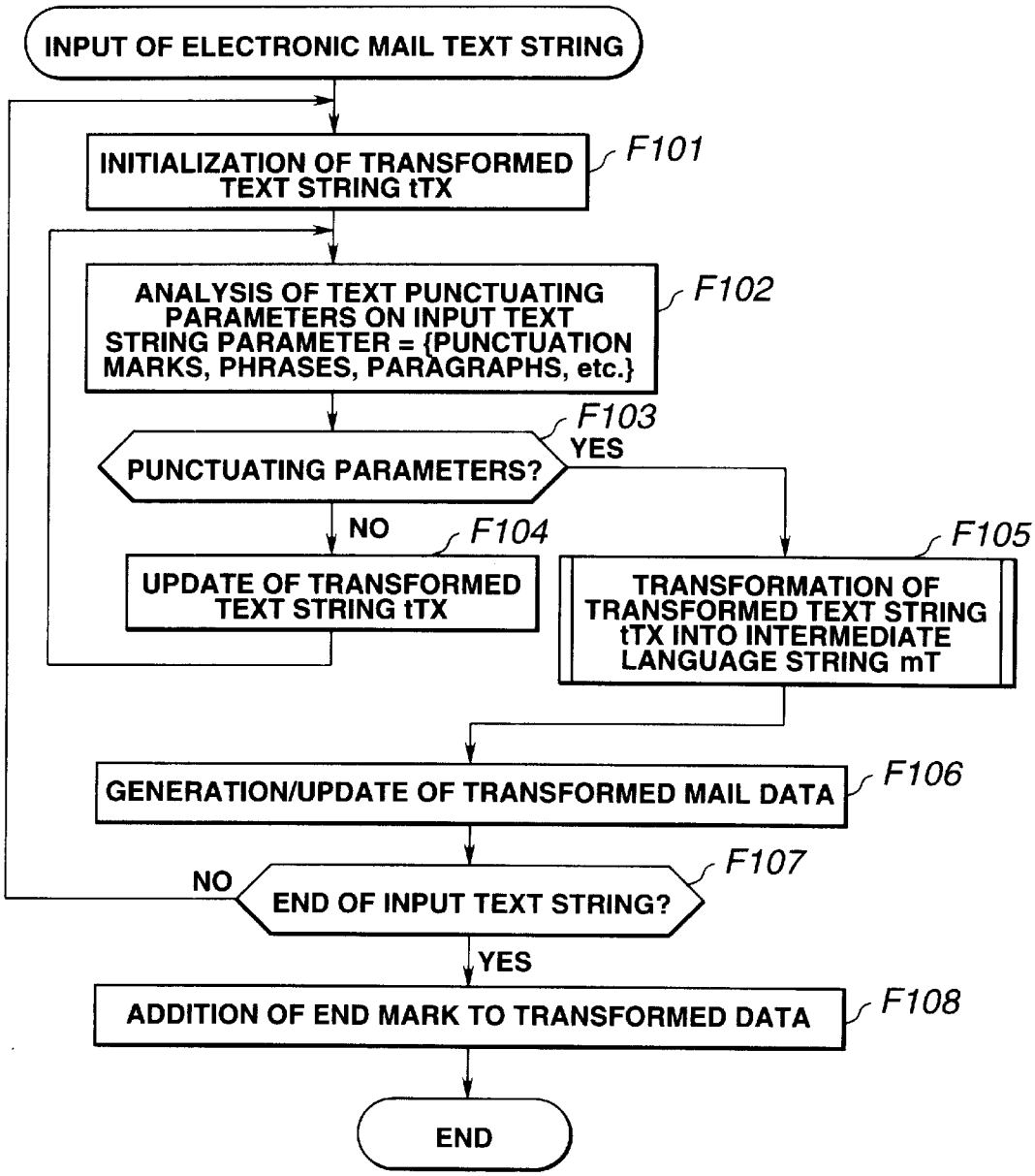
FIG. 9 is a flow chart of an operation of generating transformed data for a transform mail according to the invention.

As the electronic mail EM is taken in as text data to be transformed into intermediate language information mT, a processing operation starting from Step F101 in FIG. 9 will be executed.

Firstly, in Step F101, the data retained as a transformed text string tTX (registered data to be processed) is initialized.

Then, in Steps F102, F103 and F104, the input text string (text data of electronic mail EM) is analyzed, for example, on a character by character basis and the parameters for punctuating the text are searched for.

Text punctuating parameters represent information corresponding to punctuation marks, phrases, paragraphs and so on and are used to define sentences as so many units.

In Step F102, the input text string is analyzed on a character by character basis and, in Step F104, data (characters) other than text punctuating parameters are added to the transformed text string tTX.

When a text punctuating parameter is identified at a certain point of time, the processing operation proceeds from Step F103 to Step F105, when the text string of a sentence down to the identified punctuating parameter is retained as transformed text string tTX.

Then, in Step F105, the information retained as transform text string tTX at this point of time is transformed into an intermediate language string mT.

Figure 10:
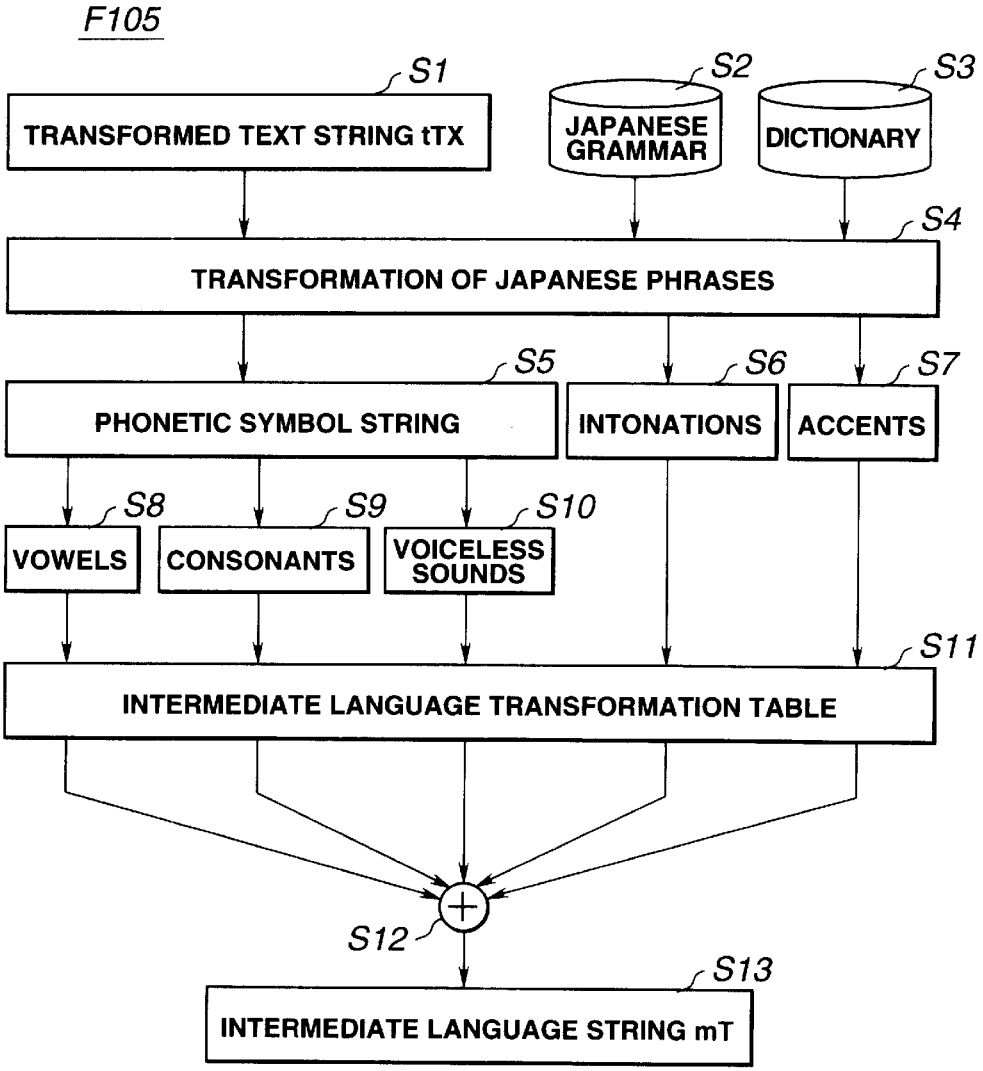
FIG. 10 is a flow chart illustrating the procedure of transforming intermediate language information according to the invention.

FIG. 10 illustrates the transformation procedure of Step F105. When a transformed text string tTX is taken in Step S1, the transform text string tTX is transformed into a Japanese paragraph (S4) by using Japanese grammar information (S2) and dictionary information (S3).

Then, information is generated for a phonetic symbol string (S5) and also for intonations and accents (S6 and S7).

Then, the phonetic symbol string is sorted into vowels, consonants and voiceless sounds (S8, S9, S10).

The vowels, the consonants, the voiceless sounds, the intonations and the accents are synthetically combined by referring to an intermediate language transformation table (S11) to generate intermediate language information mT (S13).

Then, the intermediate language information mT generated in Step F105 is transmitted to the transformed mail generating section 13 and used for generating a transformed data string D along with the transformed text string tTX in Step F106.

After generating the transformed data string SD in Step F106 by using the intermediate language information mT prepared in Step F105, it is determined in Step F107 if intermediate language information and a transformed mail is generated by using all the data of the input text string or not. If not, the processing operation returns to Step F101 to initialize the transformed text string tTX and repeats the above processing operation.

Figure 11A:
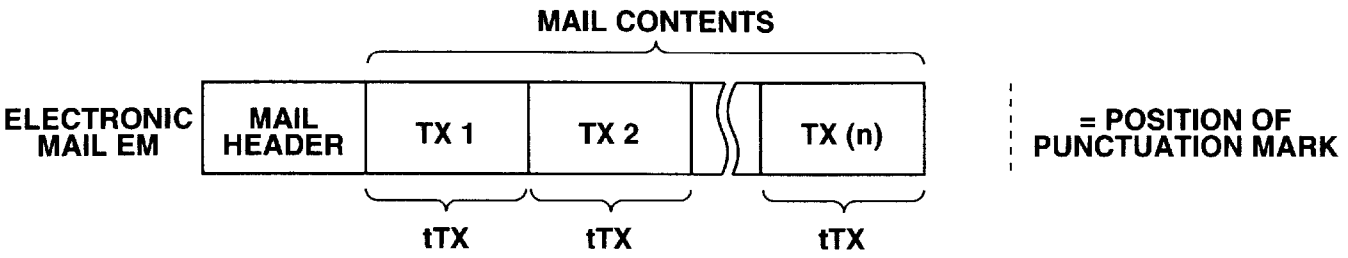
FIGS. 11A and 11B schematically illustrate an operation of generating transformed data for a transformed mail according to the invention.
Figure 11B:
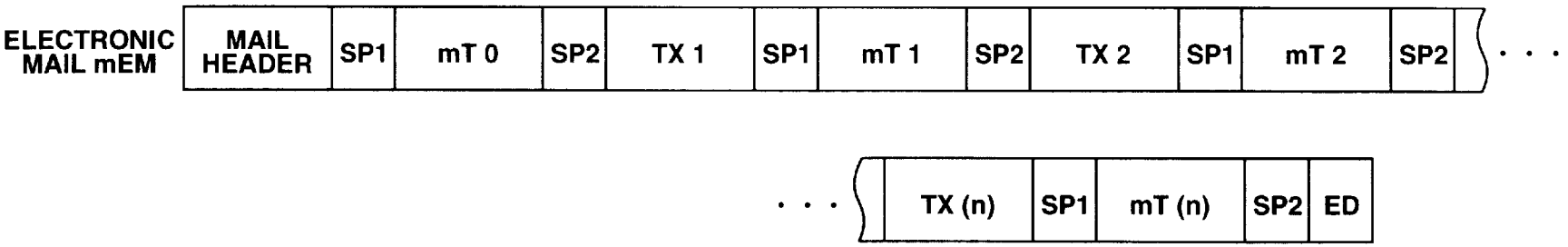

Thus, as a result of the processing operation from Step F101 to Step F107, a transformed data string SD having a configuration as shown in FIG. 11A or FIG. 11B is generated.

FIG. 11A shows a data string generated for an original electronic mail EM transmitted from a user 2.

More specifically, the data string comprises a mail header describing the name of the user from whom the mail originates, the date of transmission of the electronic mail EM by the user 3 and a text data of a character string representing the contents of the mail. The broken line in FIG. 11A indicates the punctuation mark that is used at the end of a sentence and identified as a punctuating parameter in the above described Step F102.

Thus, text strings TX1, TX2, . . . , TX(n) are turned to respective transformed text strings tTX and hence the operation of transformation into intermediate language information mT in Step F105 is conducted on a basis of transformed text string tTX by transformed text string tTX and the obtained intermediate language information mT is used for the operation of generating a transform data in Step F106. Note that the mail header is also transformed into intermediate language information mT.

Thus, the transformed data of the transformed mail mEM contains intermediate language information mTO corresponding to the mail header, intermediate language information mT1 corresponding to the text string TX1, intermediate language information mT2 corresponding to the text string TX2, . . . and intermediate language information mT(n) corresponding to TX(n) as illustrated in FIG. 11B.

Note that the text data portion and the intermediate language information mT are separated by punctuating information sp1 and punctuating information sp2, of which the punctuating information sp1 indicates the position where the text data portion tTX and the intermediate language information mT are separated from each other and the punctuating information sp2 indicates the position where intermediate language information mT ends.

As the processing operation from Step F101 to Step F107 is repeated, a new text data and corresponding new intermediate language information are added to update the data string of the transformed mail data in Step F106.

When the processing operation for processing all the data of the input text string to generate a transformed mail data string is over, the operation moves from Step F107 to Step F108, when an end mark ED is added to the transformed mail data string SD that has been generated as shown in FIG. 11B. Thus, a transformed mail data string SD is completed as a unit.

When the transformed mail data string SD is completed as an electronic mail in Step F108, the processing operation of Step F22 in FIG. 6 is also completed. Then, the processing operation of FIG. 6 proceeds to Step F23, when the mail server controller 14 takes in the transformed mail data string as transformed mail mEM.

Then, if the transformed mail mEM is to be immediately returned to the user 2, the mail server controller 14 causes it to be transmitted to the user's system 2S from the transmission/reception system 11. If it is not requested to return the transformed mail immediately (or the user is not ready for receiving the transformed mail), the processing operation proceeds to Step F25, where the transformed data string is stored in the transformed mail box 15 as transformed mail mEM. Note that, if the transformed mail mEM is returned immediately, the transformed data string may be stored in the transformed mail box 15 as transformed mail mEM.

When the transformed mail mEM is returned in Step F24, the personal computer 4 or the small terminal unit 7 of the user 2 receives the incoming transformed mail mEM in Step F11 and reproduces the transformed mail mEM in Step F12.

The transformed data string of the transformed mail mEM can contain data for various expressions. FIG. 12 shows a conceivable example of intermediate language information mT that can be contained in the transformed data string of a transformed mail mEM.

Referring to FIG. 12, it shows how a transformed data string is generated from text data "ﾎﾝｼﾞ ﾂﾜｾｲﾁﾝﾅﾘ". In this case, data string "honnjiituuwa-seiitennaari" will be generated as in Example 1. Then, "/" (slash mark) is added as punctuating information sp1 to the intermediate language information mT and the text data and then "//" (double slash mark) is added as punctuating information sp2 to the intermediate language information mT and the text data to produce a complete unit of transformed data "ﾎﾝｼﾞ ﾂﾜｾｲﾁﾝﾅﾘ"/honnjiituuwa-seiitennaari//".

While FIG. 12 illustrates a unit of data comprising a text data, punctuating information sp1, intermediate language information mT and punctuating information sp2, a multiplicity of such units may be arranged continuously as shown in FIG. 11A and FIG. 11B.

The intermediate language information mT may contain not only information on phonetic symbols as shown in FIG. 12 but also information on intonations, accents and sound volumes so that the user's system 2S may produce voices in a highly sophisticated way.

Example 2 in FIG. 12 shows intermediate language information mT as to be used as information for voicing an expression in English obtained from a text data for Japanese.

Referring to FIG. 12, text data "ﾎﾝｼﾞ ﾂﾜｾｲﾁﾝﾅﾘ" will be transformed to translated data "today is fine" and intermediate language information mT will be generated for it. Then, a data string "tudei-iz-fain" as shown in FIG. 12 will be generated. Thus, the transformed mail data generated here may comprise intermediate language information mT, a text data for the original Japanese expression, punctuating information sp1 and punctuating information sp2.

Then, the translated text data may be used as text data to be transformed. In other words, a transformed mail mEM may be obtained as transformed data from text data "today is fine" and intermediate language information mT "tudei-iz-fain". Alternatively, transformed data string SD may be formed by using the Japanese text data, the English text data and intermediate language information mT "tudei-iz-fain". Still alternatively, many other transformed data strings may be conceivable to get to the same objective.

Although not specifically illustrated, an expression in standard Japanese may be converted into a dialect and intermediate language information mT may be generated from the obtained dialectic expression as voicing information to produce a transformed data string.

When using intermediate language information mT as voicing information for a text translated into a foreign language such as English or into a dialect, information on intonations, accents and sound volumes may also be added thereto.

Additionally, many other formats may be conceivable for text data and intermediate language information mT to be used for transformed data. Therefore, appropriate formats may be provided and selectively used by users depending on the services to be provided by the system, the demand for services on the part of the users of the system and the service area of the system.

Figure 7:
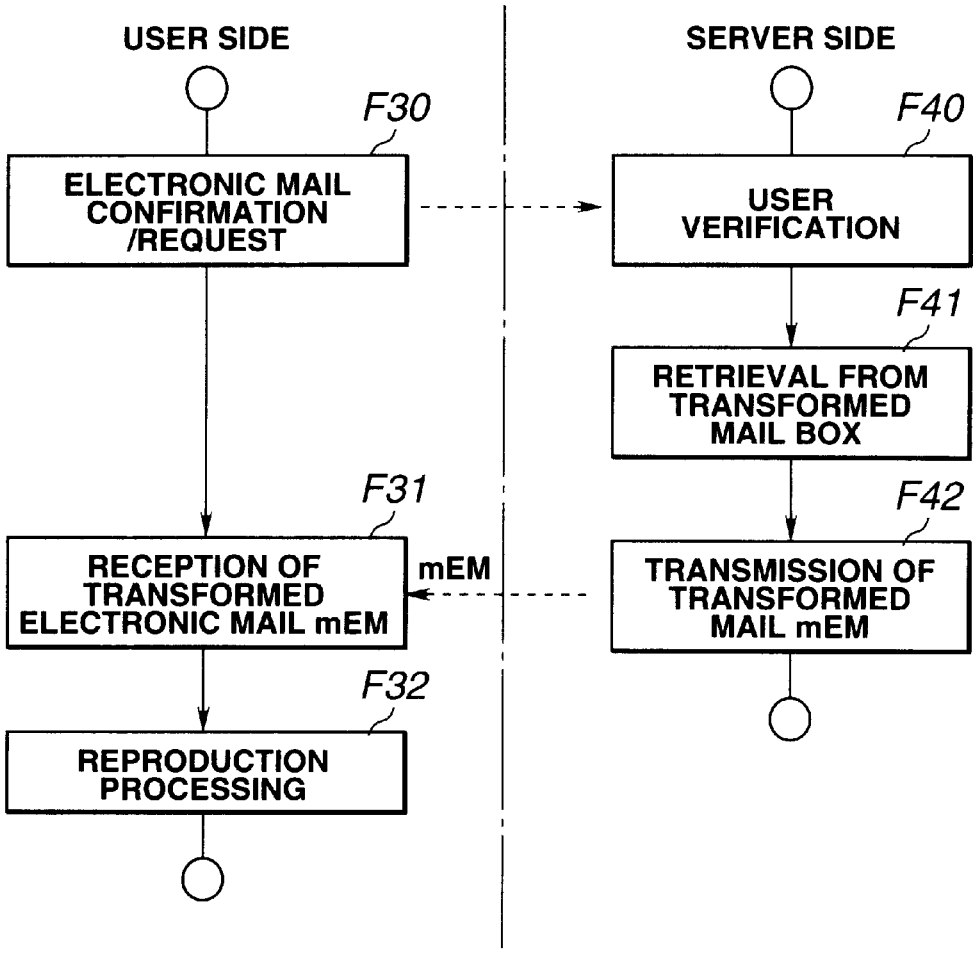
FIG. 7 is a flow chart of another mode of operation of transforming and transmitting a mail according to the invention.

Now, the operation of a system where server 1 can transmit a transformed mail mEM generated on the basis of a transformed data string to user 2 so that the user 2 can hear the voiced electronic mail addressed to him or her by means of a small terminal unit 7 by referring to FIG. 7.

For describing the processing operation of FIG. 7, it is assumed here that the server 1 has already generated transformed mail mEM on the basis of the electronic mail EM addressed to the user 2 from the other user 3 in Steps F20 through F23 of FIG. 6 and stored the transformed mail mEM in the transformed mail box 15 as transformed data in Step F25.

Thus, the electronic mail EM received by the user 2 is automatically forwarded to the server 1 typically by the personal computer 4 and the server 1 generates a transformed data string for the electronic mail EM and stores it in the transformed mail box 15 as transformed mail mEM. Alternatively, the user 1 may personally and directly forward the electronic mail addressed to him or her to the server 1, who then generates a transformed data string for the received electronic mail EM and stores it in the transformed mail box 15 as transformed mail mEM.

It will be appreciated that the transformed mail box 15 operates like a PO box for the user 2.

While, the above processing operation may be conducted either by means of the personal computer 4 or by means of the small terminal unit 7, the user 2 can be notified of the reception of a mail for the above processing operation if the user 2 carries the small terminal unit 7 for the above processing operation when he or she is out.

Referring to FIG. 7, the user 2 transmits a request for acknowledging the reception of an electronic mail to the server 1 in Step F30. Upon receiving an acknowledgment request from the user 2, the server 1 verifies the identity of the user in Step F40. More specifically, the user 2 transmits ID data of the user 2 him- or herself along with the acknowledgment request and the mail server controller 14 checks the registration of the user by referring to the ID data received by way of the transmission/reception system 11 in order to see if the user is the registered right person and authorized to receive services from the system.

If it is verified in Step F40 that the user is the registered right person, the server 1 checks in Step F41 if transformed electronic mail mEM generated on the basis of the transformed data string obtained from the electronic mail addressed to the user 2 is stored in the transformed mail box 15 or not.

If it is found in Step F41 that the transformed data string for the electronic mail is stored, the server 1 reads out the transformed data from the mail box 15 and, in Step F42, it transmits the transformed electronic mail mEM to the user's system 2S (the transmitter/receiver connected to the small terminal unit 7 or the personal computer 4) by way of the transmission/reception system 11.

While not shown in FIG. 7, if the transformed data string for the user is not found in the transformed mail box 15, a response of "no mail" is transmitted to the user 2.

Once the transformed electronic mail mEM is transmitted in Step F42, the small terminal unit 7 of the user's system 2S receives the transformed mail mEM transmitted in Step F31 and carries out a processing operation for reproducing the received transformed mail mEM on the basis of the transformed data string for the mail in Step F32. The operation of the reproducing the mail will be discussed in greater detail hereinafter.

Thus, the service of transmitting a transform electronic mail mEM to the user, using the transformed mail box 15 as a PO box, is completed.

Figure 8:
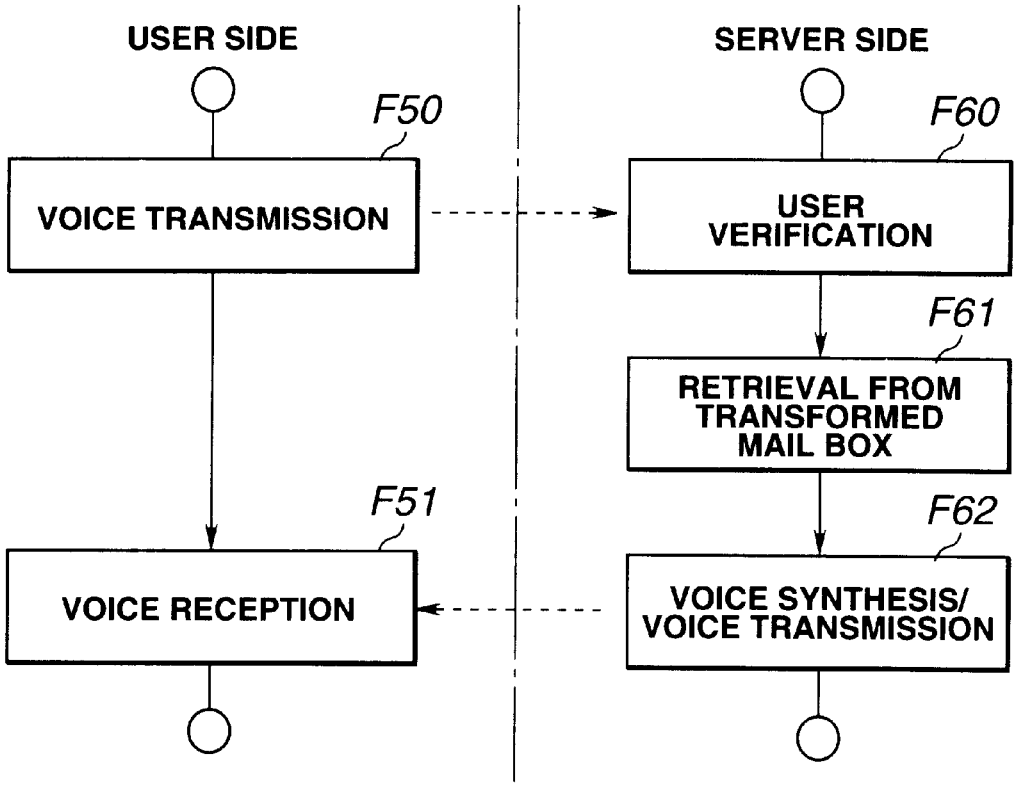
FIG. 8 is a flow chart of an operation of transmitting a voice signal for a transformed mail according to the invention.

Now, a processing operation of the server 1 of transmitting a sound signal generated on the basis of the transformed electronic mail mEM generated from an electronic mail addressed to a user 2 when the user 2 wants to hear the voided electronic mail addressed to him or her by referring to FIG. 8.

As in the case of FIG. 7 above, for describing the processing operation of FIG. 8, it is assumed here that the server 1 has already generated transformed mail mEM on the basis of the electronic mail EM addressed to the user 2 from the other user 3 in Steps F20 through 23 of FIG. 6 and stored the transformed mail mEM in the transformed mail box 15 as transformed data in Step F25.

Thus, the electronic mail EM received by the user 2 is automatically forwarded to the server 1 typically by the personal computer 4 and the server 1 generates a transformed data string for the electronic mail EM and stores it in the transformed mail box 15 as transformed mail mEM. Alternatively, the user 1 may personally and directly forward the electronic mail addressed to him or her to the server 1, who then generates a transformed data string for the received electronic mail EM and stores it in the transformed mail box 15 as transformed mail mEM.

It will be appreciated here again that the transformed mail box 15 operates like a PO box for the user 2.

This service can be used when the user 3 is out and not carrying his own small terminal unit 7 or when the user 2 cannot use the personal computer 4 for some reason or another because an ordinary telephone set 5 (a telephone owned by the user 2 or a public telephone) is used for receiving the service.

Additionally, if the user 2 does not possess such equipment, he or she can receive the service of hearing voiced letters addressed to him or her from the server 1 by only registering his or her own address.

Referring to FIG. 8, the user 2 makes a call by means of a telephone set 4 to make it to be connected to the telephone line related processing section 16 of the server 1 by way of a telephone line and transmits the own ID data and a request for checking the transformed mail box 15 by operating the push buttons typically in response to the voiced guidance of the server 1 in Step F50.

Upon receiving the request from the user 2, the mail server controller 14 of the server 1 verifies the identify of the user in Step F60. If it is verified in Step F60 that the user is the registered right person, the server 1 checks in Step F61 if transformed electronic mail mEM generated on the basis of the transformed data string obtained from the electronic mail addressed to the user 2 is stored in the transformed mail box 15 or not.

If it is found in Step F61 that the transformed data string for the electronic mail is stored, the server 1 reads out the transformed data from the mail box 15 and, in Step F62, it transmits the transformed electronic mail mEM to the telephone line related processing section 16.

The telephone line related processing section 16 extracts only the intermediate language information mT from the transformed data string and causes the voice synthesizing section 17 to carry out a voice synthesis operation. The analog sound signal output from the voice synthesizing section 17 is then transmitted by way of a telephone line and output to the user 2. Thus, the user can hear the voiced electronic mail addressed to him or her by means of the telephone set in Step F51.

With the above processing operation, an electronic mail addressed to the user 2 can be voiced and made to be heard by the user 2 by way of a telephone line as the transformed mail box 15 can be used as a PO box for the user.

Now, the operation of the small terminal unit 7 of the user 2 for reproducing the transformed electronic mail mEM that is transmitted to the user 2 in a manner as described above by referring to FIGS. 6 and 7 will be described below. Note that the processing operation as described below can be carried out also by the personal computer 4.

As described earlier, the controller 75 of the small terminal unit 7 can take in the transformed electronic mail mEM by way of the transmitter/receiver 6 or the personal computer 4.

Figure 13:
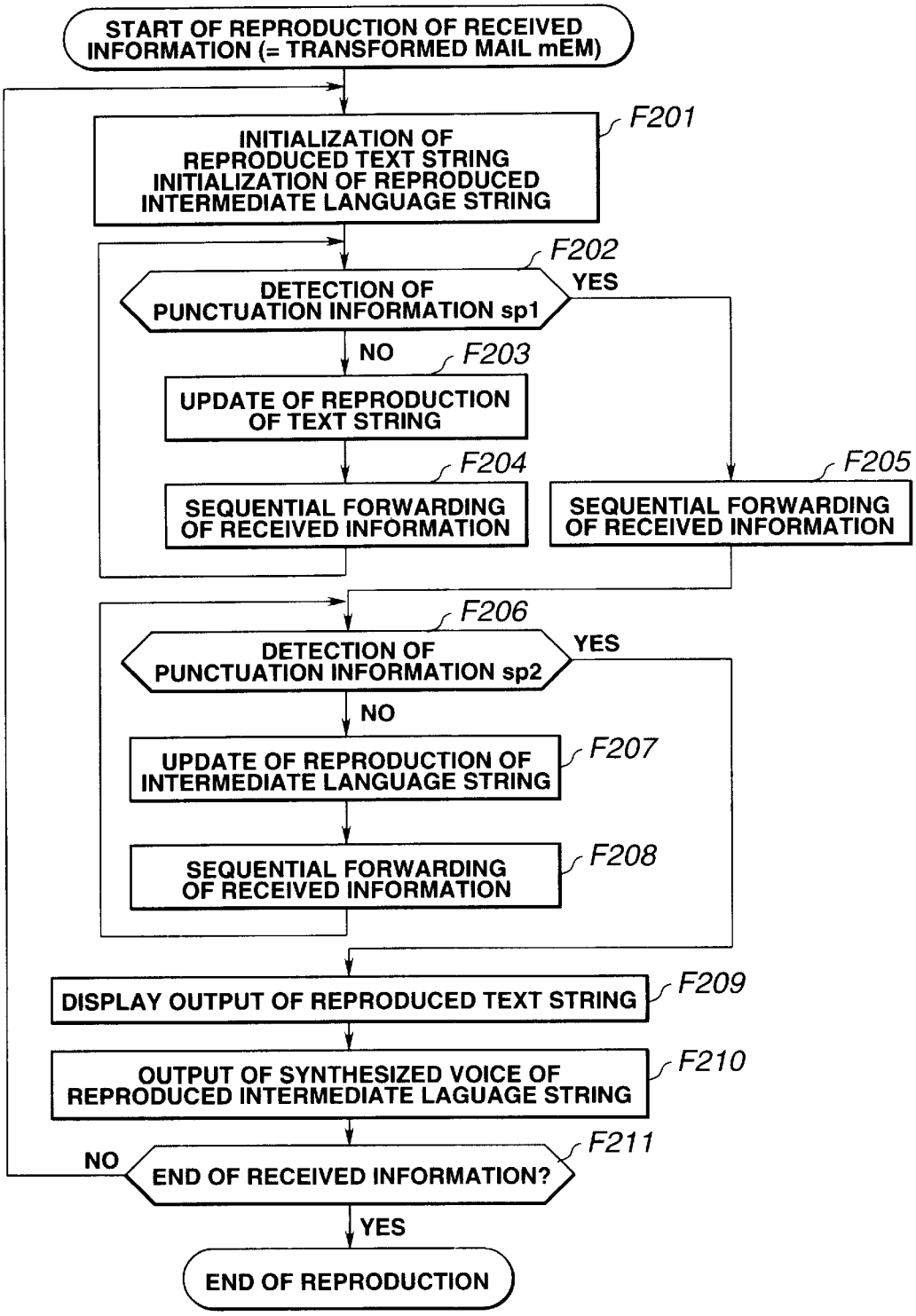
FIG. 13 is a flow chart illustrating an operation of reproducing a transformed mail at the side of the user or the addressee of the mail.

Upon receiving a command for starting an operation of reproducing the transformed electronic mail mEM received though the transmitter/receiver 6 or the personal computer 4, the controller 75 carries out a processing operation starting from Step F201 as illustrated in FIG. 13.

Firstly, in Step F201, the controller 75 initializes the reproducible text string and the reproducible intermediate language string as data string to be reproduced.

Then, in Steps F202, F203, F204, the text data is isolated from the transformed electronic mail mEM and used to generate a reproducible text string for reproducing (displaying) the text data.

More specifically, the controller 75 analyzes each of the data segments of the transformed data of the transformed mail mEM and monitors the punctuating information sp1. As for the data (characters) other than the punctuating information sp1, the reproducible text string is updated by adding the data other than the punctuating information sp1 to the text string in Step F203 and the data to be analyzed (character) is fed to the next character in Step F204 to determine type of the punctuating information sp1 detected in Step F202.

When the punctuating information sp1 is detected, a text data string TX (one of TX0 through TX(n)) is retained as a reproducible text string as will be understood from the data format of transformed data described above by referring to FIG. 11.

Then, in Step F205, the data to be analyzed of the transformed data received as transformed mail mEM is fed to the next data in Step F205 and, in Steps F206, F207 and F208, the intermediate language information mT is isolated from the transformed data of the transformed mail mEM and a reproducible intermediate language string for outputting the voiced mail is generated from the isolated intermediate language information mT. More specifically, the controller 75 analyzes each of the data segments of the transformed data of the transformed mail mEM and monitors the punctuating information sp2. As for the data (characters) other than the punctuating information sp1, the reproducible text string is updated by adding the data other than the punctuating information sp2 to the text string in Step F207 and the data to be analyzed (character) is fed to the next character in Step F208 to determine type of the punctuating information sp2 detected in Step F206.

When the punctuating information sp2 is detected, the data string of the intermediate language information mT is retained as voicing information corresponding to the text data retained as reproducible text string as a sentence.

The processing operation then proceeds to Steps F209 and F210, where the controller 75 supplies the data retained as reproducible text string to display drive circuit 79 and causes it to be displayed on the display section 81. The controller 75 also synthesizes a voice on the voicing information retained as reproducible intermediate language string and generates a synthesized sound signal, which is then supplied to the audio circuit 78 and output through the voice output section 80 as voiced electronic mail.

Thus, as a result of the processing operation of the above Steps F201 through F210, a sentence of the transformed mail mEM received by the user 2 is output in the form of voice and displayed. Then, unless the received information is confirmed and it is found that there is still data in the transformed mail mEM received by the user 2 that has not been output, the processing operation returns to Step F201 to repeat the above operation for the next reproduction and output process. If it is found that all the data have been reproduced and output, the controller 75 terminates the processing operation at Step F211.

Thus, with the above processing operation, the electronic mail addressed to the user is voiced and displayed according to the transformed mail mEM received by the user. Additionally, since a sentence of the text data and a corresponding data string of the intermediate language information mT are reproduced concurrently to reproduce the transformed mail mEM as shown in FIG. 13, the reproduced display and the reproduced voice are synchronized so that the user can read the letter displayed on the display screen while listening to the voice reading the letter.

Particularly, since the mail header as shown in FIG. 11 is also transformed into intermediate language information in this embodiment, the user can confirm the name of the sender of the electronic mail and the data when the mail is transmitted from the sender.

Additionally, the controller 75 can output a sound signal simply by carrying out a voice synthesizing operation on the basis of the intermediate language information mT that has been established as voicing information and the operation of analyzing the text data by means of a vast amount of dictionary data and grammatical data has been carried out by the server 1 so that the load on the part of the user 2 is very small particularly in terms of hardware and software.

Thus, a lightweight and compact device that costs low and consumes power at a low rate can be used for the small terminal unit 7.

In view of the fact that the personal computer 4 is used for reproducing the received electronic mail, only a relatively simple configuration will be required for the software of the personal computer 4. Then, the above system can be realized by using application software adapted to carry out the processing operation illustrated in FIG. 13.

Since a transformed information delivery system according to the invention is not adapted to transmit compressed audio signals, it is free from the problem of degraded sound quality due to compressed audio signals. Additionally, since the transmitted information includes information on accents and intonations, the system can reproduce high quality sound.

Still additionally, since a transformed electronic mail mEM transmitted by way of a data telecommunication line L1 contains only a relatively small volume of data if compared with corresponding audio data, it can be transmitted in a minimal period of time to the convenience of the user.

By using a small terminal unit 7 in a manner as described above, the user can see and hear the electronic mail addressed to him or her even when the user is out from the home. The fact that the user can hear the mail provides a great advantage particularly when the user is driving a car.

While the present invention is described above in terms of a transformed information delivery system, the above described embodiments may be modified in various different ways without departing from the scope of the invention. For example, a transformed mail is synthetically produced by combining a text data and intermediate language information in any of the above embodiments, only intermediate language information may be used for producing a transformed mail. Additionally, information other than the text data and the intermediate language information may be added to the transformed mail mEM. For example, advertisements may be added to transformed electronic mails mEM to make the use of the system free of charge.

The quality of the synthesized voice that the user hears through the reproducing terminal that may be a small terminal unit or a personal computer for the electronic mail he or she receives can be improved or modified by modifying the segment information table for voice synthesis.

Additionally, the pitch of the voice reading the mail and/or the speed at which the mail is read can be modified to meet the taste of the user.

While the present invention is described above in terms of service for transforming the text information of an electronic mail into voiced information, it will be needless to say that the present invention is applicable to services of the server for transforming text data (e.g., electronic publications) into voiced data.

INDUSTRIAL APPLICABILITY

According to the invention, the transmitter generates intermediate language information as voicing information for the text information it receives and then it generates transformed information such as transformed mail by using at least the intermediate language information and transmits it to the receiver. Upon receiving the transformed information, the receiver retrieves at least the intermediate language information from the transformed information it receives and then it synthesizes voice by using the intermediate language information and generates voice synthesis information so that the transformed information may be voiced and output. Thus, the volume of data to be transmitted can be remarkably reduced if compared with the volume of data of a sound signal that should be transmitted for the voiced information.

Then, the transmission time required for providing a service of voiced information can be reduced so that the transformed information can be delivered quickly to the user.

What is claimed is:

1. An information delivery apparatus comprising:

first reception means for receiving text data as e-mail from a first user;

immediate language generating means for generating intermediate language information on the basis of the text data received by the first reception means, wherein the intermediate language information includes voicing information associated with the text data;

transformed data generating means for generating transformed data on the basis of the intermediate language information generated by the intermediate language generating means;

transmission means for transmitting as e-mail the transformed data generated by the transformed data generating means to a plurality of users including a second user, wherein the plurality of users are specified by the first user;

second reception means associated with the second user for receiving the transformed data transmitted from the transmission means;

voice synthesizing means for retrieving the intermediate language information from the transformed data received by the second reception means and for performing voice synthesis on the retrieved intermediate language data; and output means for outputting an audible sound output signal produced by the voice synthesizing means.

2. The information delivery apparatus according to claim 1, wherein the transformed data generating means generates a plurality of sentences by detecting text punctuating parameters from the received text data.

3. The information delivery apparatus according to claim 2, wherein the intermediate language generating means generates the intermediate language information on the basis of the plurality of sentences generated by the transformed data generating means.

4. The information delivery apparatus according to claim 3, wherein the transformed data generating means generates the transformed data including a plurality of sets of each of the plurality of sentences and intermediate language information associated with the sentences.

5. The information delivery apparatus according to claim 3, wherein the intermediate language generating means generates the intermediate language information on the basis of the transformed data by using a type of information selected from information relating to vowels, consonants, voiceless sounds, intonations, and accents.

6. The information delivery apparatus according to claim 1, wherein the output means has a voice output section for outputting the audible sound.

7. The information delivery apparatus according to claim 6, wherein the output means has a display section for displaying information relating to the transformed data.

8. The information delivery apparatus according to claim 1, wherein the transformed data generating means adds an end mark to the transformed data.

9. The information delivery apparatus according to claim 1, further comprising a memory section for storing the transformed data, wherein the transmission means retrieves the transformed data from the memory section for transmission.

10. The information delivery apparatus according to claim 9, further comprising control means for determining whether the second user using said second reception means is an authorized user before transmitting the transformed data by way of the transmission means, wherein the transmission means retrieves the transformed data from the memory section for transmission when the control means determines that the second user is the authorized user.

11. An information transmitter apparatus comprising:

reception means for receiving text data as e-mail;

intermediate language generating means for generating intermediate language information on the basis of the text data received by the reception means, wherein the intermediate language information includes voicing information associated with the text data;

transformed data generating means for generating transformed data on the basis of the intermediate language information generated by the intermediate language generating means;

storage means for storing the transformed data generated by the transformed data generating means; and transmission means for retrieving the transformed data stored in the storage means and for transmitting as e-mail the retrieved transformed data, wherein when the reception means receives a request signal from a user, the transmission means retrieves the transformed data stored in the storage means associated with the request signal and transmits the retrieved transformed data to the user and to a plurality of other users specified by the user.

12. The information transmitter apparatus according to claim 11, wherein the transformed data generating means generates a plurality of sentences by detecting text punctuating parameters from said received text data.

13. The information transmitter apparatus according to claim 12, wherein the intermediate language generating means generates the intermediate language information on the basis of the a plurality of sentences generated by the transformed data generating means.

14. The information transmitter apparatus according to claim 13, wherein the transformed data generating means generates the transformed data including a plurality of sets of each of the plurality of sentences and intermediate language information associated with the sentences.

15. The information transmitter apparatus according to claim 11, wherein the transformed data generating means adds an end mark to the transformed data.

16. The information delivery apparatus according to claim 1, wherein the intermediate language generating means translates the text data into another language and generates voicing information associated with the translated text data as the intermediate language information.

17. The information delivery apparatus according to claim 1, wherein the intermediate language generating means rewrites the text data in another dialect and generates voicing information associated with the rewritten text data as the intermediate language information.

18. An information delivery apparatus comprising:

a server unit having:

first reception means for receiving transmitted text data as e-mail from a first user, intermediate language generating means for generating intermediate language information on the basis of the text data received by the first reception means, wherein the intermediate language information includes voicing information associated with the text data;

transformed data generating means for generating transformed data on the basis of the intermediate language information generated by the intermediate language generating means, and first transmission means for transmitting as e-mail the transformed data generated by the transformed data generating means to a plurality of users including a second user, wherein the plurality of users are specified by the first user; and a terminal unit associated with the second user having:

second reception means for receiving the transformed data transmitted from the first transmission means, voice synthesizing means for retrieving the intermediate language information from the transformed data received by the second reception means and for performing voice synthesis on the retrieved intermediate language data, and output means for outputting an audible sound output signal produced by the voice synthesizing means.

19. The information delivery apparatus according to claim 18, wherein the transformed text data generating means generates a plurality of sentences by detecting text punctuating parameters from the received text data.

20. The information delivery apparatus according to claim 19, wherein the intermediate language generating means generates the intermediate language information on the basis of the plurality of sentences generated by the transformed data generating means.

21. The information delivery apparatus according to claim 20, wherein the transformed data generating means generates the transformed data including a plurality of sets of each of the plurality of sentences and intermediate language information associated with the sentences.

22. The information delivery apparatus according to claim 20, wherein the intermediate language generating means generates the intermediate language information on the basis of the transformed data by using a type of information selected from information relating to vowels, consonants, voiceless sounds, intonations, and accents.

23. The information delivery apparatus according to claim 18, wherein the output means has a voice output section for outputting the audible sound.

24. The information delivery apparatus according to claim 23, wherein the output means has a display section for displaying information relating to the transformed data.

25. information delivery apparatus according to claim 18, wherein the transformed data generating means adds an end mark to the transformed data.

26. The information delivery apparatus according to claim 18, further comprising a memory section for storing the transformed data, wherein the transmission means retrieves the transformed data from the memory section for transmission.

27. The information delivery apparatus according to claim 26, wherein said server unit further includes control means for determining whether the second user using said second reception means is an authorized user before transmitting the transformed data by way of the first transmission means, wherein the first transmission means retrieves the transformed data from the memory section for transmission when the control means determines that the second user is the authorized user.

28. The information delivery apparatus according to claim 18, wherein the intermediate language generating means translates the text data into another language and generates voicing information associated with the translated text data as the intermediate language information.

29. The information delivery apparatus according to claim 18, wherein the intermediate language generating means rewrites the text data in another dialect and generates voicing information associated with the rewritten text data as the intermediate language information.

30. An information delivery method comprising the steps of:

receiving text data as e-mail from a first user;

generating intermediate language information on the basis of the received text data, wherein the intermediate language information includes voicing information associated with the text data;

generating transformed data on the basis of the generated intermediate language information;

transmitting as e-mail the generated transformed data to a plurality of users including a second user, wherein the plurality of users are specified by the first user;

receiving by the second user the transmitted transformed data;

retrieving the intermediate language information from the received transformed data and performing voice synthesis on the retrieved intermediate language data for producing an audible sound; and outputting the audible sound.

31. The information delivery method according to claim 30, further comprising the step of generating a plurality of sentences by detecting text punctuating parameters from the received text data.

32. The information delivery method according to claim 31, wherein the intermediate language information is generated on the basis of the generated plurality of sentences.

33. The information delivery method according to claim 32, wherein the transformed data is generated including a plurality of sets of each of the plurality of sentences and intermediate language information associated with the sentences.

34. The information delivery method according to claim 32, wherein the intermediate language information is generated on the basis of the transformed data by using a type of information selected from information relating to vowels, consonants, voiceless sounds, intonations, and accents.

35. The information delivery method according to claim 34, further comprising the step of displaying information relating to the transformed data.

36. The information delivery method according to claim 30, further comprising the step of adding an end mark to the transformed data.

37. The information delivery method according to claim 30, further comprising the step of temporarily storing the generated transformed data.

* * * * *